United States Patent [19]

Hunter

[11] Patent Number: 4,932,590

[45] **Date of Patent: * Jun. 12, 1990**

[54] ROTARY STREAM SPRINKLER UNIT WITH ROTOR DAMPING MEANS

[76] Inventor: Edwin J. Hunter, 5551 Codorniz Rd., Rancho Sante Fe, Calif. 92067

[ * ] Notice: The portion of the term of this patent subsequent to Mar. 28, 2006 has been disclaimed.

[21] Appl. No.: 389,946

[22] Filed: Aug. 7, 1989

[51] Int. Cl.[5] ..... B05B 3/04

[52] U.S. Cl. ..... 239/222.17; 239/205; 239/206; 239/252; 239/259

[58] Field of Search ..... 239/200–206, 239/222.17, 222.19, 251, 252, 259, DIG. 1

[56] References Cited

U.S. PATENT DOCUMENTS

| | | | |
|---|---|---|---|
| 3,006,558 | 10/1961 | Jacobs | 239/222.17 |
| 3,052,574 | 9/1962 | Kennedy, Jr. | 239/252 |
| 3,854,664 | 12/1974 | Hunter | 239/206 |
| 4,440,345 | 4/1984 | Figwer et al. | 239/252 |
| 4,471,908 | 9/1984 | Hunter | 239/206 |
| 4,624,412 | 11/1986 | Hunter | 239/206 |
| 4,660,766 | 4/1987 | Nelson et al. | 239/222.17 |
| 4,796,811 | 1/1989 | Davisson | 239/222.17 |
| 4,815,662 | 3/1989 | Hunter | 239/222.17 |
| 4,842,201 | 6/1989 | Hunter | 239/240 |

*Primary Examiner*—Andres Kashnikow
*Assistant Examiner*—Michael J. Forman
*Attorney, Agent, or Firm*—Baker, Maxham, Jester & Meador

[57] ABSTRACT

A rotary stream sprinkler unit comprises a housing having a water flow passage in which is disposed a flow control unit having one or more passages configured to control the volume and pressure of a stream, which strikes and rotates a self-propelled rotary distributor head rotatably mounted at the outlet of the housing for dividing each stream into a plurality of final streams, and rotating each of the final streams through a selected arc during the rotation of the rotary head, with a damping device in the housing connected to the rotary head by means of a shaft supported by a resilient member at the outlet for controlling the rotational velocity thereof.

19 Claims, 2 Drawing Sheets

ROTARY STREAM SPRINKLER UNIT WITH ROTOR DAMPING MEANS

BACKGROUND OF THE INVENTION

The present invention relates to sprinkler units, and pertains particularly to a rotary stream sprinkler unit with damping means.

In my prior Pat. Ser. No. 3,854,664, issued Dec. 17, 1974, entitled "SPRINKLER SYSTEMS", I disclose a sprinkler unit which has a rotating head that directs a plurality of rotating streams over an area to be watered. The streams of water are formed in nozzles in the rotating head. The rotating head has inlets to the nozzle on one end, which engages and cooperates with an orifice plate for acting as a valve for controlling communication of pressurized water to the nozzles. A turbine and reduction gear unit drives the head at a controlled velocity.

My U.S. Pat. Ser. No. 4,471,908, issued Sept. 18, 1984, entitled "PATTERN SPRINKLER HEAD", discloses a similar sprinkler unit having V-shaped nozzles in a cylindrical rotating head. The nozzle inlet openings cooperate with an orifice in an orifice plate to vary the nozzle openings to the source of pressurized water. This combination delivers streams of water of variable length and volume from the nozzles in the distributor head. The rotating head is driven at a substantially constant velocity or rate of rotation by means of a turbine and reduction drive gearing. Such construction is complex and expensive to manufacture.

In a subsequent application co-pending herewith, a plurality of passages in the unit forms nozzles which controls the stream size and velocity delivered to an open channel distributing head. The streams from the nozzles are directed into a plurality of open channels on a rotating distributor head for forming and distributing the streams.

The rotating head in the above described units is driven by a turbine through a reduction drive gear assembly within the body of the sprinkler unit.

Sprinkler heads have been known wherein the distributor head is self-propelling, or more particularly stream propelled. The sprinkler head is rotated either by streams of water flowing from jets or nozzles in the head, or by blades on the head struck by a stream of water causing it to rotate.

Among the problems of the prior art self-propelled device is that it is difficult to control the velocity of rotation of the head. The velocity of rotation of the head is affected by friction, stream pressure and velocity, and other factors, which ultimately determine the reach or distance that the distributed water travels from the head. The higher the velocity of rotation of the head, the shorter the reach of the streams from the head will be.

The present invention is an improvement in the invention in my prior Pat. Ser. No. 4,815,662, issued Mar. 28, 1989, entitled "STREAM PROPELLED ROTARY STREAM SPRINKLER UNIT WITH DAMPING MEANS", which is incorporated herein by reference as though fully set forth. In that patent, I disclose a sprinkler unit which has a rotating head that is self-propelled and directs a plurality of rotating streams over an area to be watered. The velocity of the rotating head is controlled by means of a damping unit inside the sprinkler housing and connected to the head by a common rotatable shaft. A nozzle in the housing shapes the stream to the rotating head, and the streams of water directed outward are formed in nozzles in the rotating head. The rotating shaft is mounted in a damper unit housing at the inner end and in a portion of the housing at the outer end. Sealing of the shaft against fine sand and grit and against water leakage into the damper unit is a major problem.

Some attempts have been made in the past to control the velocity of rotation of the distributor head by some type of damping means. However, these attempts have been unsatisfactory.

Accordingly, it is desirable that an improved rotary stream sprinkler unit be available.

SUMMARY AND OBJECTS OF THE INVENTION

It is therefore the primary object of the present invention to provide an improved rotary stream sprinkler unit.

In accordance with the primary aspect of the present invention, a rotary stream sprinkler unit comprises a housing having one or more stream nozzles for providing a predetermined stream volume and velocity, with a multiple channel rotor positioned at the outlet of the flow passages, rotating in response to the stream, and for dividing the stream into a plurality of streams, and selectively distributing the streams over a predetermined area, with an improved damping means for controlling the velocity of rotation of the distributor head.

BRIEF DESCRIPTION OF THE DRAWINGS

The above and other objects and advantages of the present invention will become apparent from the following description when read in conjunction with the drawings wherein:

FIG. 5 is an end view of the distributor head.

DETAILED DESCRIPTION OF A PREFERRED EMBODIMENT

Figure 1:
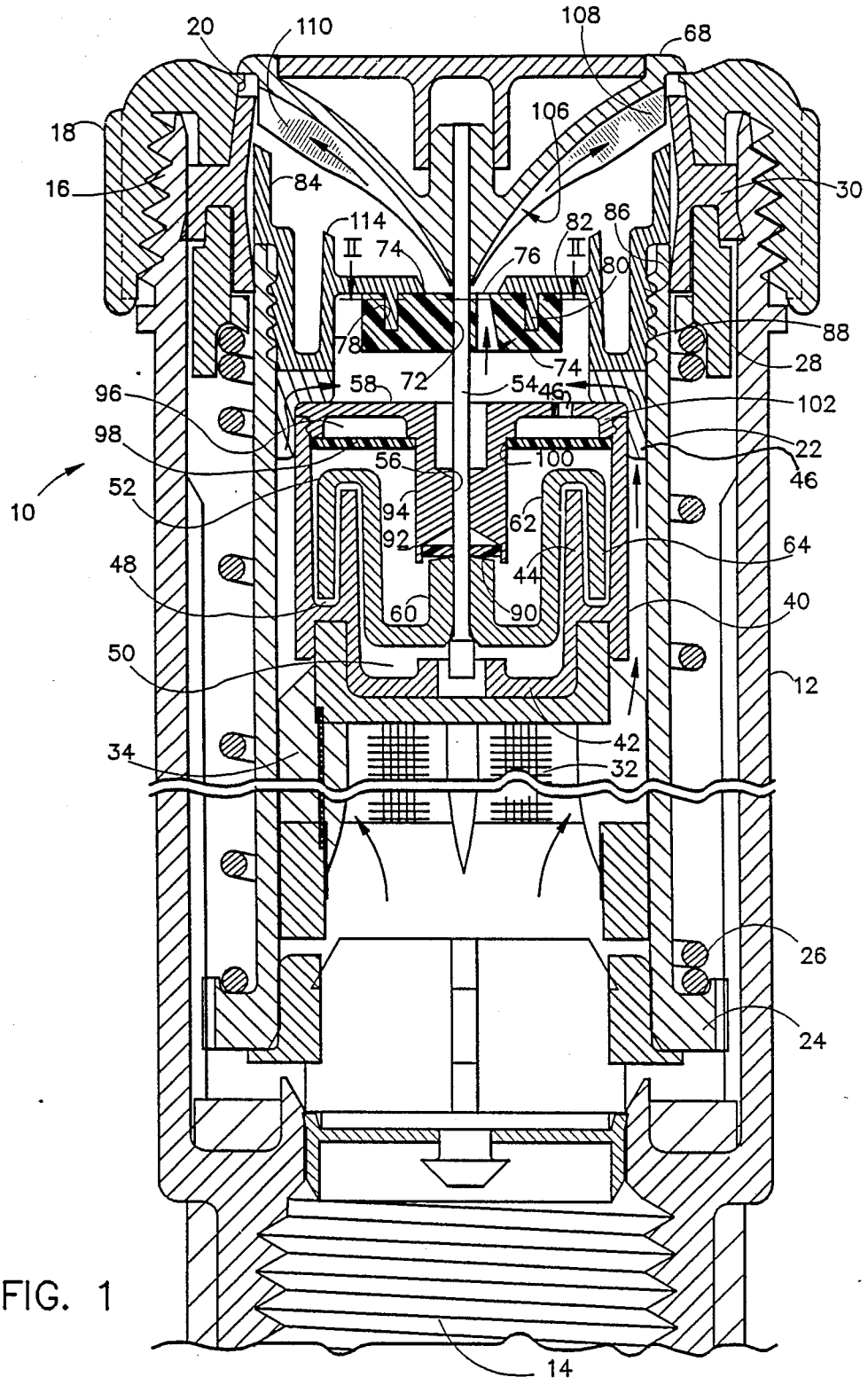
FIG. 1 is a side elevation view of a sprinkler unit in accordance with the invention.

Referring to FIG. 1 of the drawings, there is illustrated a sprinkler unit constructed in accordance with a preferred embodiment of the invention. The sprinkler unit, designated generally by the numeral 10, comprises an elongated generally cylindrical tubular housing 12, having a threaded inlet port 14 at one axial end, which shall be termed the lower end attachable to a suitable source of water under pressure, such as a riser.

The opposite or upper end of the housing is open and is considered the outlet end thereof. The outlet end is provided with outer annular threads 16 for receiving a retainer ring or cap 18 for retaining a pop-up assembly, as will be explained. The cap 18 has a central bore 20 for accommodating the telescopic extension of an inner tubular pop-up housing or sleeve 22, which is telescopically and reciprocally mounted within the housing 12 for extension upward to an operative position, and retraction to a non-operative position (not shown), as illustrated in FIG. 1.

The inner housing 22 includes a radially extending flange 24 at the lower end thereof, which extends outward and engages the interior surface of the wall of the outer housing 12, and also serves as a retainer for a retracting spring 26, which biases at its lower end against the flange 24 and its upper end against an annular ring 28. The ring 28 seats against an annular seal 30, which engages the outer surface of the inner housing 22, and is biased against retainer cap 18 by ring 28 and spring 26.

The driving and flow control structure for the sprinkler unit is mounted on and within the inner housing 22, and carried therewith as the housing is extended upward into the operative position. Mounted within the lower end of the inner housing 22, within the tubular central bore thereof, is a generally tubular screen 32 having radially extending ribs 34, forming a passageway 36 up to and around a damper unit 38 for controlling the velocity of the rotary nozzle, as will be explained.

The damper unit comprises a removable stationary housing or stator member, defined by a generally cylindrical stator housing member 40 having a closed end wall 42, and an inner axially extending annular wall 44 forming a tubular extension 44. The housing 40 includes radial ribs 46, which engages the inner surface of sleeve or inner housing 22 and forms a water flow passage around housing 22. The stator housing 40 thus forms a housing divided into a central cylindrical chamber 50 and an outer annular chamber 48.

Disposed within the stator member 40 is a rotor unit, comprising a rotor drum 52 mounted on a rotating shaft 54, which is rotatably mounted within a bore 56 of a housing cap or closure member 58. The rotor is complementary to the housing, with central hub 60 on the lower end of the shaft 54 and formed within a cylindrical portion 62, and having an outer sleeve 64 extending into the space or annular chamber 48 between walls 40 and 44 of the stator. The opposed cylindrical surfaces of the stator 40 and rotor 52 may have ribs for enhancing the drag of the rotor. The stator housing is filled with a suitable damping fluid, such as silicone or any suitable viscous damping oil. The viscosity of the damping fluid may be selected to provide the desired damping.

The drive shaft 54 is drivingly connected at its lower o inner end to the rotor 52 by any suitable means, such as splines, keys, press fitting or the like. The drive shaft 54 extends upward through and is journaled in a bore 72 in a resilient nozzle member 76, and is connected at the upper end to a multiple channel distributing cap or head 68 by means of similar suitable securement in a bore 70. The shaft extends along the flow passage, and is sealed in bore 56 by a silicone disc or washer seal 90 within a bore or recess 92 of a hub 94 of housing cap 58. The seal 90 is biased into sealing engagement with the shaft 54 and the end of hub 60 by water pressure within the flow passage that may leak along bore 56. The seal 90 is thus located within the damper housing chamber.

Figure 2:
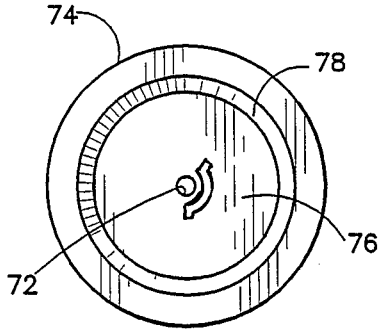
FIG. 2 is a view taken on line II—II of FIG. 1.

The shaft 54 extends through a bore 72 in the nozzle or flow control unit 74, having one or a plurality of flow control nozzles or passages 76 therein. The nozzle unit 74 has a generally disc shape, with an annular groove portion 78 mounted on an annular rim or tubular extension 80 of an end cap or extension 82 of the inner housing 22. An outer annular skirt 84 of the extension unit 82 forms retaining cap for the extension of inner housing 22. The axially extending end cap portion 84 is formed with external threads 86, and threadably engages complementary threads 88 in the upper end of the inner housing or sleeve 22. Thus, flow control o nozzle units having different shape and size nozzles can be selectively mounted in any one sprinkler unit The drive shaft 54 is sealed in or at the inner end of bore 56 by an annular seal member 90 seated in a recess 92, and in bore 72 by the resilience of the combined nozzle, journal and seal member 74 (FIG. 2). The seal of bore 72 onto shaft 54 inhibits the flow of water along the bore between the shaft and bore wall, and inhibits the flow or passing of fine grit and sand into this space. In addition, the resilience of the member 74 enables the wall of bore 72 to yield, and when sand and grit are present, prevents and/or avoids seizing or gripping the shaft. The seal 90 is essential in that it prevents entry of water into the damping chamber 48 and 50, where it will contaminate the damping fluid therein.

The damping unit is provided with an expansion chamber in the form of an annular cavity 96 on the inner side of cap 58. This annular cavity or chamber is covered by a diaphragm 98 having an inner bore 100 that sealingly engages hub 94 of cap 58. The diaphragm 98 is sealed at its outer rim against an outer skirt 102 of the cap 58 and/or the inner surface of housing 40. This expansion chamber contains air or a gas that accommodates expansion and contraction of the damping fluid within housing 40 and relieves pressure on the seals.

Figure 3:
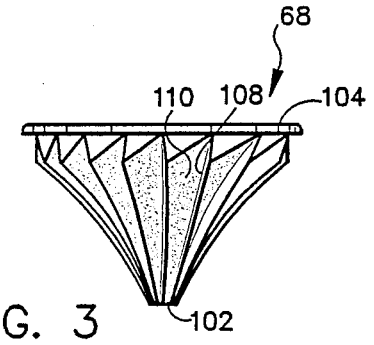
FIG. 3 is a side elevation view of the distributor head.
Figure 4:
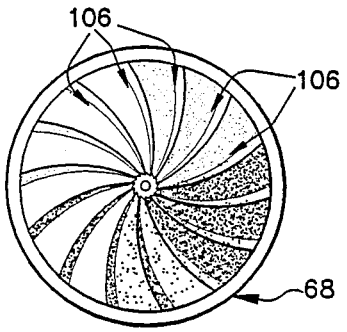

Referring to FIGS. 3 and 4, the distributor head 68 is formed with a plurality of combined channels and turbine blades, and serves the dual function of propelling itself and forming and distributing streams of water over a surrounding area. The distributor head 68 has a somewhat curved or concave frusto-conical outer configuration. As can be seen in FIGS. 1 and 4, the outer surface of the distributor head curves slightly outward from the apex axis to the base of the cone (i.e. top of the cap). A plurality of curved channels or grooves 106 extend from the apex to the base of the cone or top of the head 68. These channels 106 all curve in the same direction around the axis, and each have a vertical wall 108 at the outside of the curve, and a sloped wall 110 on the inside of the curve. These walls form combined flow channels and turbine blades. The channels also have a continuously increasing depth from the apex to the base.

One or more nozzles 76 in unit 74, which will be further explained hereinafter, delivers one or more shaped streams of water to the apex end of distributing cap 68, which rotates in response thereto. The plurality of channels in cap 68 forms multiple streams, and directs the streams of water by way of the plurality of flow channels radially outward from the sprinkler unit, and rotates the streams through an arc. The streams of water issuing from nozzle 74 enter the channels 106 at the apex 112 and flow axially along and radially outward along the channel to its outlet from the head 68.

The present sprinkler unit, as described above, is designed to distribute streams of water throughout a selected area. Water will be distributed on the side of the axis having nozzle 76, and the shape of the area will be determined by the cross-sectional shape of the nozzle 76. For example, the sprinkler unit has the capability, with proper nozzle configuration, of distributing streams of water over an area having substantially any desired shape, as disclosed in my prior patents. See, for example, my U.S. Pat. Ser. No. 4,842,201, entitled "ROTARY STREAM SPRINKLER UNIT", granted June 27, 1989, and incorporated herein by reference as though fully set forth. The sprinkler unit may be positioned in the center of the area to be covered or to one side thereof. The unit accomplishes this by means of the shape of the nozzle 76 in the unit 74, which controls the volume and velocity of portions of the primary flow stream to the distributor head 68, which forms and distributes each flow stream.

The distributor head 68 (FIGS. 3 and 4) has a plurality of curved channels for forming and rotating each stream across a particular arc or area of the plot determined by the location and shape of the nozzle 76. The action of the primary stream of water directed to the rotor or distributor head 68 also causes it to rotate. Thus, the distributor head 68 forms its own propelling turbine.

An appreciation of the construction and operation of the distributor head will be obtained from a view of FIGS. 3 and 4 and the following explanation herein. As shown in FIGS. 3 and 4, the distributor cap has a generally horn or conical configuration, with a small diameter lower or inner end 112, and a larger diameter outer or top end 114, with a plurality of curved open water channels 106 extending therebetween. The water channels 106 each include an inlet end at the apex 112, and an outlet end at the base of the head, with a vertical sidewall 108 and a sloped sidewall 110 extending, as can be seen from FIG. 4, from a minimum depth at the inlet end 112 to a maximum minimum depth extending to the outlet 114. The channels 106 are curved such that the outlet end at 104 is at an angle to a radial through the axis of the distributor cap.

The channels thus form turbine blades that drive or rotate the distributor head 68 in response to one or more streams of water, striking it from one or more nozzles or passage 76. An annular skirt 114 on the inside of cap member 82 aids in directing the flow of water into the channels 106. The channels 106 form a plurality of final streams from each arcuate stream directed thereto via passage 76. The distributor head, as can be seen in FIG. 1, sits directly over the flow nozzle 74, and the inner or lower ends of the channels 106 are disposed directly over the outlet of the flow passage or passages 76. It is nestled within a protective cavity formed by member 82.

As will be appreciated from FIGS. 3 and 4, an outlet of a stream passage 74 is directed into the inner end of the flow channels 106, which causes rotation of the rotary distributor head 68. The rotation of the head directs the outer end of the flow stream along an arc at the end of its reach. A flow stream will have somewhat of an arc shape, and is directed into the inner end at apex 112 of a plurality of the flow channels 106. The stream will continue to flow into a channel, with a rotation of the cap along an arc as long as the channel overlaps the passage or nozzle 74, as shown.

The length of the arc at the outer end of the stream will be determined by width of nozzle outlet 76, and the radius from the center axis of the rotor to the position of striking of the stream at its outer end. Thus, as the distributing cap is rotating, a particular flow channel 106 maintains communication with the flow passage for a certain degree of rotation thereof. As long as the inner end of the flow channel is in communication with a particular nozzle or flow passage, a portion of the water from that flow passage will be directed along the flow channel 106, along an arc determined by where the inner end of the flow channel picks up the flow passage, and where it drops that flow passage for the next one.

As the distributing cap rotates, a particular channel 106 will pick up and distribute flow from a flow passage 76, or the flow passages disposed around the flow control unit in sequence in the direction of rotation of the distributing cap. Thus, a portion of each primary flow stream will be in sequence, picked up by a flow channel 106 as it registers with that stream, and will distribute it along an arc or direct it along an arc as the cap rotates. The length of the stream and its coverage of the surface area will be determined by the volume, velocity and other characteristics of the stream, as determined by the configuration of nozzle 76.

The damper unit will impose a drag on the distributor head, so that it will maintain a reasonable velocity of rotation for a given range of water pressure. A reasonably low rate of rotation will enable the streams from channels 106 to maintain a stream and attain a maximum reach. Means may be provided, such as knobs or the like, along the outer rim of the distributor head to extend into a few of the streams from the channels 106, to break up the streams and distribute water inwardly toward the sprinkler unit from the streams normal outer reach.

While I have illustrated and described my invention by means of a specific embodiment, it is to be understood that numerous changes and modifications may be made therein without departing from the spirit and scope of the invention as defined in the appended claims.

I claim:

1. A rotating stream sprinkler unit comprising:

a tubular housing having a central axis, an inlet, an outlet, and a flow passage communicating therebetween for conducting a primary stream of water from said inlet to said outlet;

distributor means rotatably mounted at said outlet for receiving said primary stream of water, for rotating in response thereto, and for directing said stream outward from the axis of said housing over a selected area;

damping means disposed in said housing up stream of said outlet and operatively connected to said distributor means by a rotatable shaft extending along said flow passage for controlling the velocity of rotation thereof; and resilient means at said outlet for rotatably supporting said shaft.

2. A rotary stream sprinkler according to claim 1 wherein:

said resilient means comprises a circular disc having a central bore for supporting said shaft and a nozzle adjacent said bore for forming said primary stream.

3. A sprinkler unit according to claim 2 wherein: said damping means comprises a generally cylindrical chamber in said housing;

a quantity of damping fluid in said chamber; and a generally cylindrical rotor on said shaft disposed in said chamber.

4. A sprinkler unit according to claim 3 wherein:

said chamber includes annular wall means therein; and said rotor includes means defining an annular recess for receiving said annular wall means.

5. A sprinkler unit according to claim 4 wherein:

said damping means is disposed coaxially within said housing upstream of said outlet.

6. A sprinkler unit according to claim 5 wherein:

said rotor and said distributor means are connected by said shaft extending coaxially along said flow passage.

7. A rotary stream sprinkler according to claim 1 wherein:

said distributor means comprises a distributor head having a plurality of curved axially and radially extending flow channels for defining turbine blades and for forming and directing a plurality of individual streams outward therefrom.

8. A rotary stream sprinkler according to claim 1 wherein:

said distributor means comprises a generally conical shaped member having a plurality of curved grooves extending along the conical surface thereof from the apex to the base thereof; and said apex is disposed at said outlet.

9. A sprinkler unit according to claim 1 wherein:

a body member mounted in said flow passage; and at least one substantially arcuate nozzle in said body member disposed in a circular arc and extending along said body member parallel to said central axis toward said outlet.

10. A rotary stream sprinkler according to claim 1 wherein:

said distributor means comprises a generally conical shaped member having a plurality of curved grooves extending along a conical surface thereof from an apex to a base thereof; and said apex is disposed at said outlet.

11. A sprinkler unit according to claim 10 wherein:

a body member mounted in said flow passage; and at least one substantially arcuate flow passage in said body member disposed in a circular arc and extending along said body member parallel to said central axis toward said outlet.

12. A sprinkler unit according to claim 11 wherein:

said damping means comprises a generally cylindrical chamber in said housing;

a quantity of damping fluid in said housing; and a generally cylindrical rotor disposed in said chamber.

13. A rotary stream sprinkler unit comprising:

a tubular housing having a central axis, an inlet, an outlet, and a flow passage communicating therebetween for conducting a primary stream of water from said inlet to said outlet;

an elongated rotor shaft rotatably mounted at said outlet and having an inner end and an outer end;

resilient support means for rotatably supporting the outer end of said elongated shaft;

distributor means mounted on the outer end of said shaft for receiving said primary stream of water, for rotating in response thereto, and for directing said stream outward from the axis of said housing over a selected area;

damping means disposed in said housing on the inner end of said elongated shaft for controlling the velocity of rotation of said distributor means.

14. A rotary stream sprinkler according to claim 13 wherein:

said distributor means and said damping means are mounted on a common shaft coaxially of said central axis.

15. A rotary stream sprinkler according to claim 14 wherein:

said distributor means comprises a distributor head having a plurality of curved radially extending flow channels.

16. A rotary stream sprinkler according to claim 14 wherein:

said distributor head comprises a generally conical shaped member having a plurality of curved grooves extending along a conical surface thereof from an apex to a base thereof; and said apex is disposed at said outlet.

17. A sprinkler unit according to claim 16 wherein:

a body member mounted in said channel; and at least one substantially arcuate flow passage in said body member disposed in a circular arc and extending along said body member parallel to said central axis toward said outlet.

18. A sprinkler unit according to claim 17 wherein:

said damping means comprises a generally cylindrical chamber in said housing;

a quantity of damping fluid in said housing; and a generally cylindrical rotor disposed in said chamber.

19. A sprinkler unit according to claim 18 wherein:

said chamber includes annular wall means therein; and said rotor includes means defining an annular recess for receiving said annular wall means.

* * * * *

UNITED STATES PATENT AND TRADEMARK OFFICE

CERTIFICATE OF CORRECTION

PATENT NO. : 4,932,590

DATED : June 12, 1990

INVENTOR(S) : Edwin J. Hunter

It is certified that error appears in the above—identified patent and that said Letters Patent is hereby corrected as shown below:

On sheet 1 of the drawing, delete the reference numeral "46" above cap 58 with lead line to the illustrated orifice.

Signed and Sealed this

Twenty-seventh Day of August, 1991

*Attest:*

HARRY F. MANBECK, JR.

*Attesting Officer*

*Commissioner of Patents and Trademarks*